US008448699B2

(12) United States Patent
Camilleri et al.

(10) Patent No.: US 8,448,699 B2
(45) Date of Patent: May 28, 2013

(54) ELECTRICAL SUBMERSIBLE PUMPING SYSTEM WITH GAS SEPARATION AND GAS VENTING TO SURFACE IN SEPARATE CONDUITS

(75) Inventors: Lawrence Camilleri, Paris (FR); Brian Scott, Aberdeen (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 317 days.

(21) Appl. No.: 12/756,894

(22) Filed: Apr. 8, 2010

(65) Prior Publication Data

US 2010/0258306 A1 Oct. 14, 2010

Related U.S. Application Data

(60) Provisional application No. 61/168,400, filed on Apr. 10, 2009, provisional application No. 61/184,174, filed on Jun. 4, 2009.

(51) Int. Cl.
*E21B 43/14* (2006.01)

(52) U.S. Cl.
USPC ..... 166/54.1; 166/369

(58) Field of Classification Search
USPC ..... 166/265, 105.5, 369, 54.1
See application file for complete search history.

(56) References Cited

U.S. PATENT DOCUMENTS

| | | | | |
|---|---|---|---|---|
| 2,905,099 | A | 9/1959 | Turner | |
| 5,154,588 | A | 10/1992 | Freet | |
| 6,017,456 | A * | 1/2000 | Kennedy et al. | 166/265 |
| 6,179,056 | B1 | 1/2001 | Smith | |
| 6,260,626 | B1 * | 7/2001 | Rivas | 166/369 |
| 6,325,143 | B1 * | 12/2001 | Scarsdale | 166/54.1 |
| 2003/0141056 | A1 * | 7/2003 | Vandevier | 166/265 |
| 2008/0093085 | A1 * | 4/2008 | Knight et al. | 166/369 |
| 2008/0245525 | A1 * | 10/2008 | Rivas et al. | 166/265 |

* cited by examiner

*Primary Examiner* — Brad Harcourt
(74) *Attorney, Agent, or Firm* — Jim Patterson

(57) ABSTRACT

A technique enables independent lifting of fluids in a well. The technique utilizes an electric submersible pumping system which is disposed in a wellbore and encapsulated by an encapsulating structure. The encapsulating structure has an opening through which well fluid is drawn to an intake of the electric submersible pumping system. A dual path structure is positioned in cooperation with the electric submersible pumping system and the encapsulating structure to create independent flow paths for flow of a gas component and a remaining liquid component of the well fluid. The independent flow paths also are arranged to prevent contact between the well fluid components and a surrounding wellbore wall.

7 Claims, 7 Drawing Sheets

ELECTRICAL SUBMERSIBLE PUMPING SYSTEM WITH GAS SEPARATION AND GAS VENTING TO SURFACE IN SEPARATE CONDUITS

CROSS-REFERENCE TO RELATED APPLICATION

The present document is based on and claims priority to U.S. Provisional Application Ser. No. 61/168,400, filed Apr. 10, 2009, and U.S. Provisional Application Ser. No. 61/184,174, filed Jun. 4, 2009, herein incorporated by reference.

BACKGROUND

In a variety of well related applications, electric submersible pumping systems often are placed downhole in an oil well or a gas well to perform a variety of functions. These functions may include artificial lift, in which an electric submersible pumping system drives a pump to lift fluids to a surface location. Power for pumping or other work is provided by one or more submersible electric motors. The submersible motor in combination with the submersible pump and other cooperating components is referred to as the electric submersible pumping system.

One issue which sometimes arises when pumping well fluids from a downhole location is an excessive presence of gas in addition to liquids, such as oil and water. The presence of gas can create difficulties for the electric submersible pumping system. Another issue related to the presence of gas is detrimental contact between the gas and a surrounding well casing. If the gas is separated and transmitted uphole, the gas component can damage the casing due to the acidic nature of the gas. If the casing damage becomes sufficiently severe, the integrity of the casing may become compromised and problems, e.g. escaping gas, can result.

SUMMARY

In general, the present invention provides a technique for lifting fluids in a well. The technique utilizes an electric submersible pumping system which is disposed in a wellbore and encapsulated by an encapsulating structure. The encapsulating structure has an opening through which well fluid is drawn to an intake of the electric submersible pumping system. Additionally, a dual path structure is positioned in cooperation with the electric submersible pumping system and the encapsulating structure. The dual path structure creates independent flow paths for independently conducting flow of a gas component of the well fluid and a remaining liquid component of the well fluid. The independent flow paths also are arranged to prevent contact between the well fluid components and the surrounding wellbore wall, e.g. well casing.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally involves a system and methodology related to the lifting of fluids in a well. The system and methodology enable separation of fluid components for independent movement of those fluid components along the wellbore without contacting the surrounding wellbore wall, e.g. well casing. An electric submersible pumping system is encapsulated with an appropriate encapsulating structure and deployed into a wellbore. Well fluid is drawn into the encapsulating structure which separates it from contact with the surrounding wellbore wall as it moves toward the electric submersible pumping system. The well fluid is split into separate fluid components, e.g. a gas component and a liquid component, and one of the fluid components, e.g. liquid component, is pumped up through the wellbore via the electric submersible pumping system. However, the separated fluid components are moved through the wellbore along independent flow paths which are maintained separate from the surrounding wellbore wall, e.g. well casing. It should be noted that the gas component and a liquid component are not necessarily solely gas and liquid but rather substantially gas and substantially liquid components separated from the original well fluid.

According to one embodiment, the technique may be employed to combine three functions in a single well. In this embodiment, the technique is employed to produce oil with an electric submersible pumping system. The technique also utilizes a pod or other encapsulating structure to isolate well fluids from the surrounding production casing to avoid, for example, corrosion issues and/or well casing integrity concerns. The technique further provides mechanisms for separating gas within the pod prior to entering the submersible pump of the electric submersible pumping system. The separated gas component and the remaining liquid component are routed to a surface location or other suitable location along independent flow paths which avoid contact with the casing. For example, the gas component may be routed to the surface through tubing separate from the production tubing. The creation of independent flow paths again protects the well casing from the corrosive effects of the separated gas. Creation of the dual path structure also facilitates applications in areas where gas venting is not allowed for various well control reasons. The present approach provides a method for venting gas with a double barrier to satisfy the constraints associated with production in geographical regions which limit gas venting.

Figure 1:
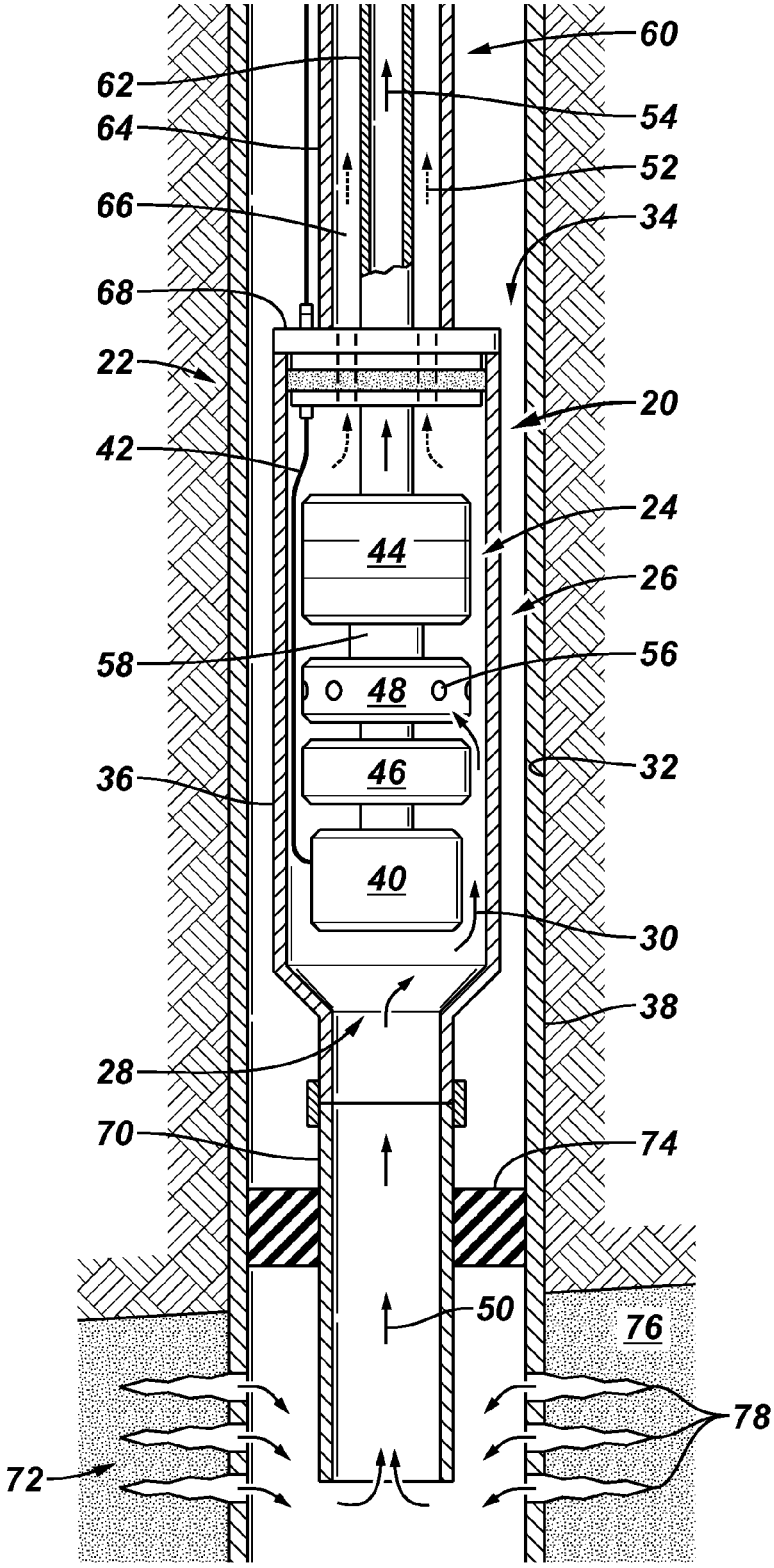
FIG. 1 is a front elevation view of a system for lifting fluids while deployed in a wellbore, according to an embodiment of the present invention.

Referring generally to FIG. 1, an example of a system 20 for lifting fluids in a well 22 is illustrated. In this embodiment, an electric submersible pumping system 24 is surrounded or encapsulated by an encapsulating structure 26 into which well fluid is drawn through an opening 28. The encapsulating structure 26 creates a flow path 30 along the electric submersible pumping system 24 that is separated from the surrounding wellbore wall 32 of a wellbore 34 into which electric submersible pumping system 24 and encapsulating structure 26 are deployed. In the specific embodiment illustrated, encapsulating structure 26 comprises a pod 36, and wellbore wall 32 is formed by a well casing 38.

Electric submersible pumping system 24 may comprise a variety of components depending on the specific pumping application for which it is deployed. In the example illustrated, electric submersible pumping system 24 comprises a submersible motor 40 which receives electrical power via a power cable 42 routed downhole through wellbore 34. By way of example, submersible motor 40 may comprise a three-phase electric motor having one or more rotors, stators and motor windings. Electric submersible pumping system 24 further comprises a submersible pump 44, such as a centrifugal pump, which is powered by submersible motor 40 through a motor protector 46.

Additionally, a gas separator 48 may be used to separate inflowing well fluid 50 into a gas component 52 and a liquid component 54. It should be noted that the liquid component 54 may contain some gas but the reduction in gas allows the fluid to be better produced with electric submersible pumping system 24. For example, the liquid component 54 may be produced to a collection location as a three phase fluid with reduced gas content. In the embodiment illustrated in FIG. 1, gas separator 48 is positioned within encapsulating structure 26 between the submersible motor 40 and the submersible pump 44 and includes a gas separator intake 56. After separation of gas, the remaining fluid, e.g. liquid component 54, is delivered to a pump intake 58. The fluid flowing into pump intake 58 has the lower gas content which enables more efficient operation of submersible pump 44 when producing liquid component 54 to the desired collection location.

The flows of fluid components 52, 54 are directed by a dual path structure 60 which is coupled in cooperation with electric submersible pumping system 24 and encapsulating structure 26. The dual path structure 60 provides independent flow paths for the liquid component 54 and the gas component 52 along the wellbore 34 while remaining separated from the surrounding wellbore wall 32, e.g. well casing 38. In the embodiment illustrated, dual path structure 60 comprises a pipe-in-pipe structure, e.g. a concentric pipe structure, having an internal tube 62 and an outer tube 64 which surrounds the internal tube 62 to create an annulus 66. By way of example, the liquid component 54 may be directed along the interior of inner tube 62, while the gas component 52 is directed along the annulus 66 between inner tube 62 and outer tube 64.

The dual path structure 60 may be engaged with electric submersible pumping system 24 and encapsulating structure 26 by a variety of mechanisms, depending on the overall design of system 20. In the embodiment of FIG. 1, the dual path structure 60 is connected to pod 36 and to electric submersible pumping system 24 via a pod hanger 68. Pod hanger 68 may be designed according to the desired routing of the gas component 52 and liquid component 54. For example, pod hanger 68 is designed with specific passages to route the gas component and the liquid component to specific, separate channels of dual path structure 60.

Additionally, well fluid may be drawn into encapsulating structure 26 via a variety of mechanisms and systems. By way of example, a tubular member 70 is connected to encapsulating structure 26 proximate opening 28 and extends down along wellbore 34 to a desired well zone 72. In the embodiment illustrated, tubular member 70 extends down through a packer 74 to well zone 72. Well fluid flows into wellbore 34 from a surrounding formation 76 at well zone 72 via perforations 78 formed through casing 38. Accordingly, the well fluid 50 and its separated fluid components 52, 54 are isolated from casing 38 all the way from well zone 72 to a desired collection location, such as a surface collection location.

Figure 2:
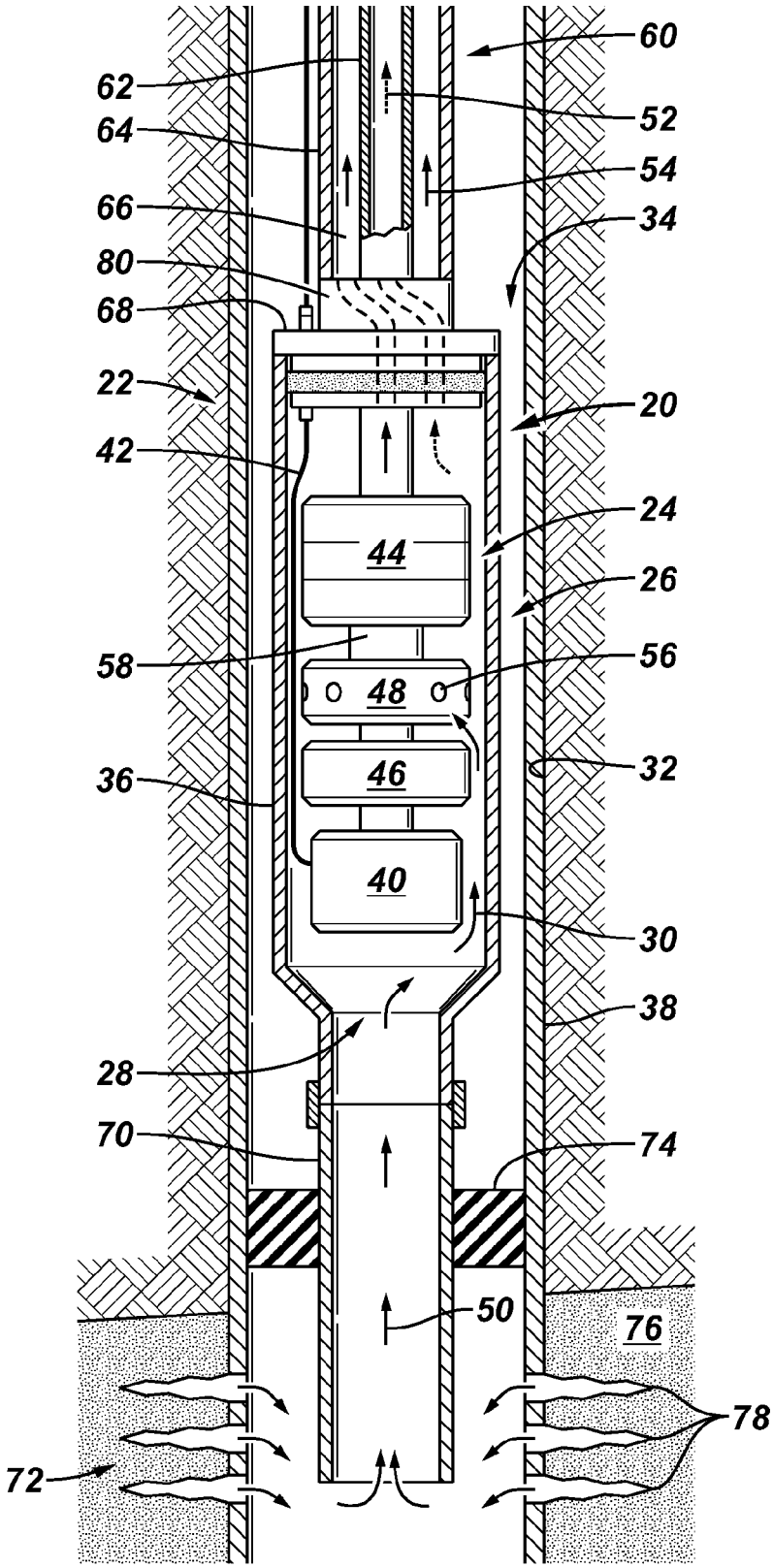
FIG. 2 is a front elevation view of another example of a system for lifting fluids while deployed in a wellbore, according to an embodiment of the present invention.

In FIG. 2, an alternate embodiment of system 20 is illustrated. In this embodiment, the components are arranged similarly to that illustrated in FIG. 1 and as described above. However, the dual path structure 60 works in cooperation with a special crossover 80 which may be positioned proximate pod hanger 68. The crossover 80 directs the gas component 52 into inner tube 62 and the liquid component 54 into the annulus 66 between inner tube 62 and outer tube 64.

Figure 3:
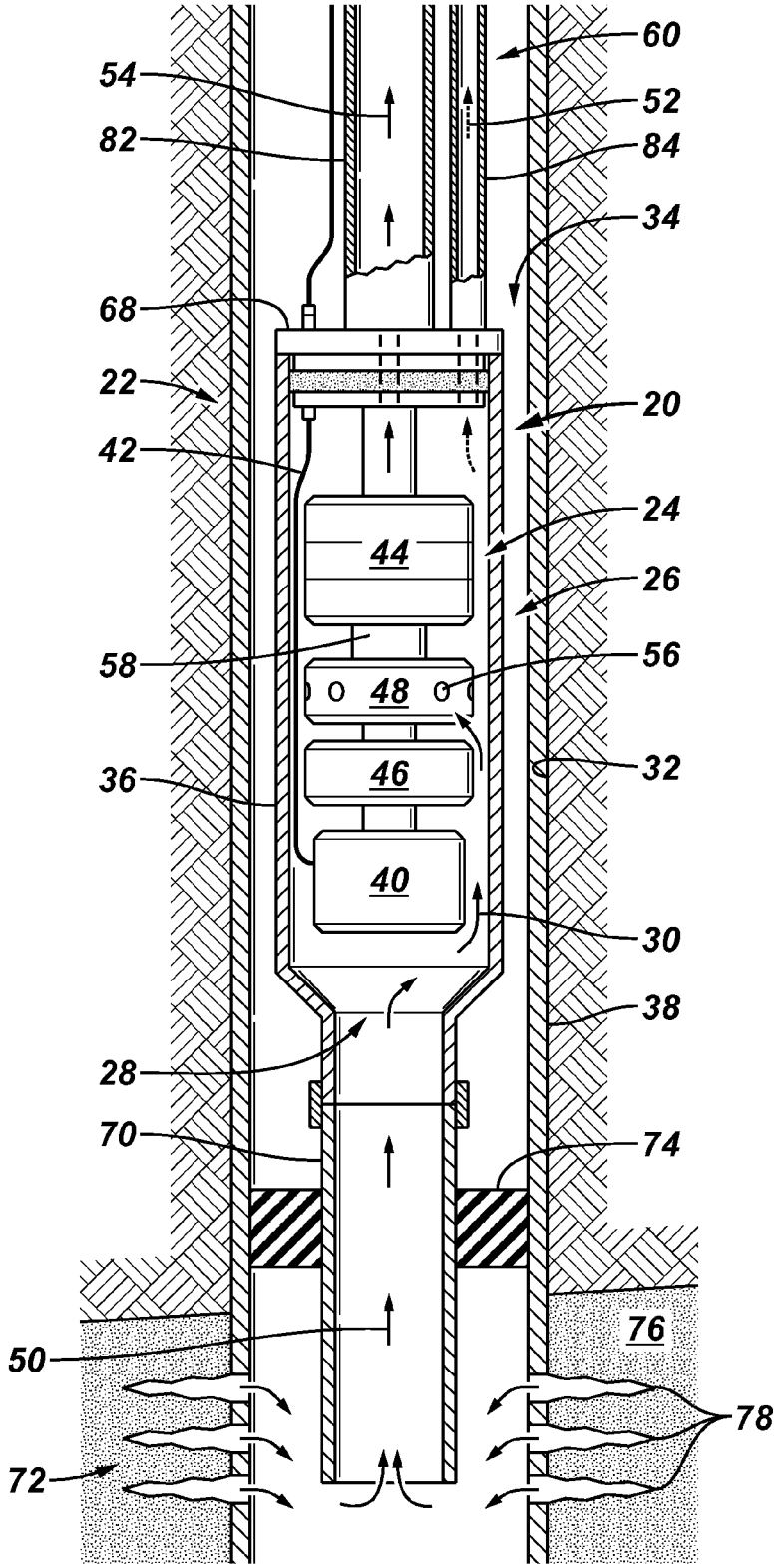
FIG. 3 is a front elevation view of another example of a system for lifting fluids while deployed in a wellbore, according to an embodiment of the present invention.

In FIG. 3, another alternate embodiment of system 20 is illustrated. In this embodiment, the components are arranged similarly to that illustrated in FIG. 1 as described above. However, the dual path structure 60 comprises a pair of tubes 82, 84 which are positioned side by side. In some embodiments, tubes 82 and 84 may be generally parallel and extend from encapsulating structure 26 to a surface location. The two tubes 82, 84 are used to independently carry the separated fluid components. For example, tube 82 may be used to carry the reduced gas liquid component 54, while the tube 84 is used to carry the primarily gas component 52.

According to an embodiment, a separate conduit can be run in parallel to the production tubing, such as coiled tubing or control line, which is small enough to be connected and run with the main production tubing on a single RIH (Run in Hole). The separate conduit can be strapped to main tubing by some form of mechanical connector. As an example, the main production tubing can carry produced fluids, 3 phase but with reduced gas content, while separated gas is produced up the separate conduit, which can be one of the following: a control line or a coiled tubing.

The various components described above may be adapted for use in many applications and environments. For example, pod 36 may have a variety of sizes and shapes. Additionally, pod 36 may be used to divert fluids from below an isolation packer into the electric submersible pumping system, or pod 36 may be used to direct the discharge of one electric submersible pumping system into an intake of another electric submersible pumping system. In some applications, the pod 36 may be arranged to commingle fluids produced from multiple zones. Pod 36 also is designed to isolate fluids from the well casing 38 to prevent overpressure, corrosion, erosion, and/or other detrimental effects. In some applications, pod 36 may be used to suspend a lower completion or to create a bypass which allows fluid flow past the electric submersible pumping system when the electric submersible pumping system is not in operation.

The gas separator 48 also may have a variety of designs depending on the specific application, environment, and types of fluids to be produced. When the gas content of a well fluid is sufficiently high to cause risk of "gas lock" in the electric submersible pumping system, at least some of the gas must be removed to create a liquid component with lower gas content. Gas content in the well fluid also can reduce the hydraulic efficiency of the electric submersible pumping system and, in some cases, drastically reduced the number of barrels of oil produced per day. Gas separator 48 may have a variety of designs to remove this excess gas. By way of example, gas separator 48 may be a natural separator, a reverse flow gas separator, a centrifugal gas separator, a tandem rotary gas separator. In some applications, the gas separator employs or works in cooperation with a bottom feeder intake, as discussed below.

Figure 4:
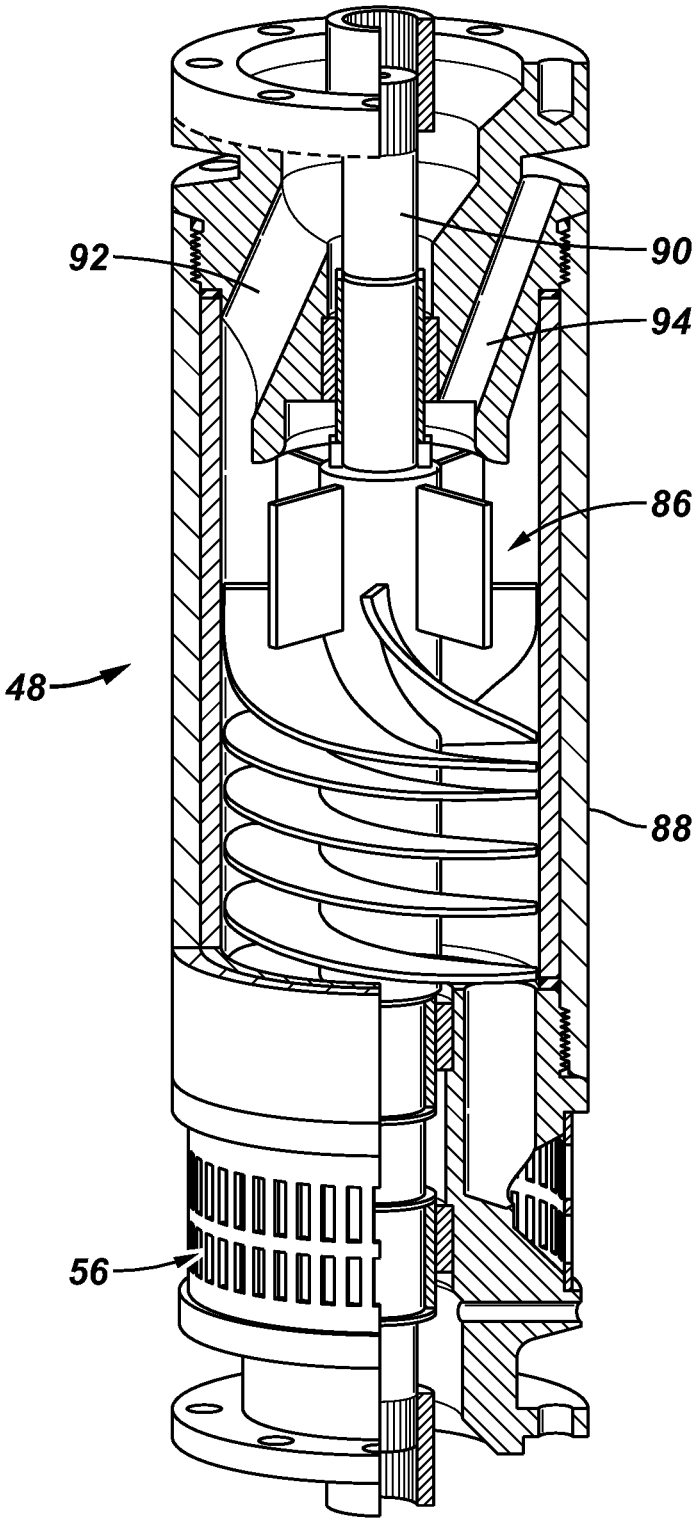
FIG. 4 is a partial, cross-sectional view of one example of a gas separator for use in the system for lifting fluids, according to an embodiment of the present invention.

Referring generally to FIG. 4, one example of gas separator 48 is illustrated. In this particular example, gas separator 48 comprises a centrifugal or rotary gas separator having a separator element 86 rotatably mounted within a separator housing 88 via a shaft 90. Well fluid moves into gas separator 48 through separator intake 56 while separator element 86 is rotating to separate the gas component 52 from the remaining liquid component 54. The heavier liquid element is centrifugally moved to a radially outward region and travels out of the gas separator 48 through a flow passage 92. The lighter gas element remains radially inward and travels out of the gas separator through a separate flow passage 94. The separated gas component 52 and liquid component 54 may then be routed to appropriate independent and isolated channels of dual path structure 60 for production to a surface location or other collection location.

Figure 5:
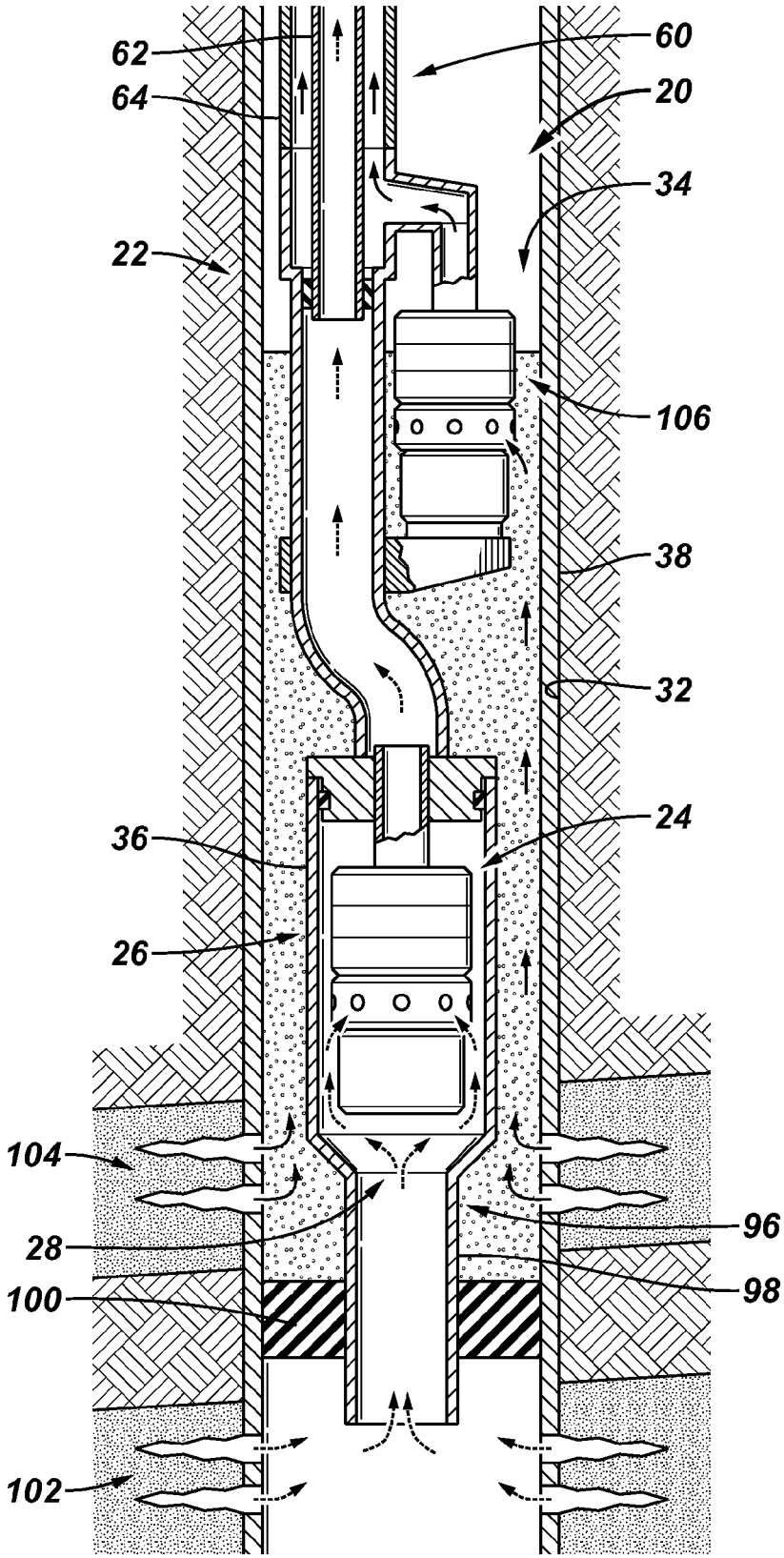
FIG. 5 is a schematic view of another example of a system for lifting fluids in which the system comprises a bottom feeder assembly, according to an embodiment of the present invention.

In FIG. 5, another embodiment of system 20 is illustrated with a bottom feeder intake assembly 96 in which an intake tubular 98 extends down from pod 36 to an isolation packer 100 for drawing fluid from a lower well zone 102. In some embodiments, packer 100 comprises a seal bore packer. In this particular example, system 20 is deployed in a wellbore having a second well zone 104. Well zone 102 and second well zone 104 are separated by isolation packer 100, and fluid is produced from well zone 102 by electric submersible pumping system 24. However, a secondary electric submersible pumping system 106 is used to produce fluid from the second well zone 104. The two fluid streams produced by electric submersible pumping system 24 and the second electric submersible pumping system 106 are routed to the surface along independent flow channels via dual path structure 60 without contacting well casing 38.

Figure 6:
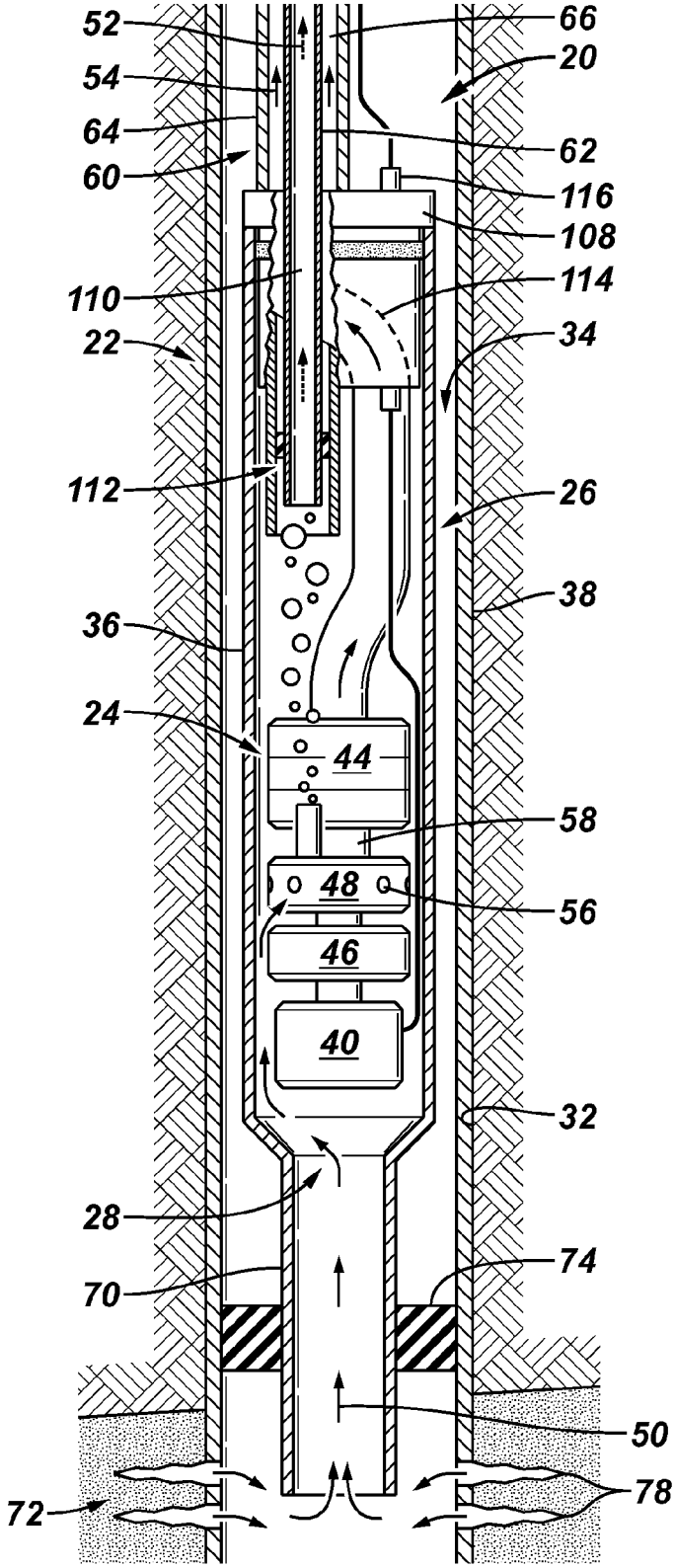
FIG. 6 is a schematic illustration of another example of a system for lifting fluids while deployed in a wellbore, according to an embodiment of the present invention.

Referring generally to FIG. 6, another embodiment of system 20 is illustrated. The embodiment of FIG. 6 is similar to the embodiment described above with reference to FIG. 2 in which gas component 52 is routed up through inner tube 62 of dual path structure 60 and liquid component 54 is routed up through the annulus 66 between inner tube 62 and outer tube 64. However, FIG. 6 illustrates an integrated flow crossover and pod hanger assembly 108. In this example, the integrated assembly 108 is coupled directly with pod 36 and includes a gas component passage 110 into which a stinger 112 of the inner tube 62 is deployed. The integrated assembly 108 also comprises a liquid component passage 114 formed to direct the liquid component 54 into the annulus 66. Additionally, integrated assembly 108 may comprise an opening for receiving a power cable penetrator 116 through which power is supplied to submersible motor 40 of electric submersible pumping system 24.

Figure 7:
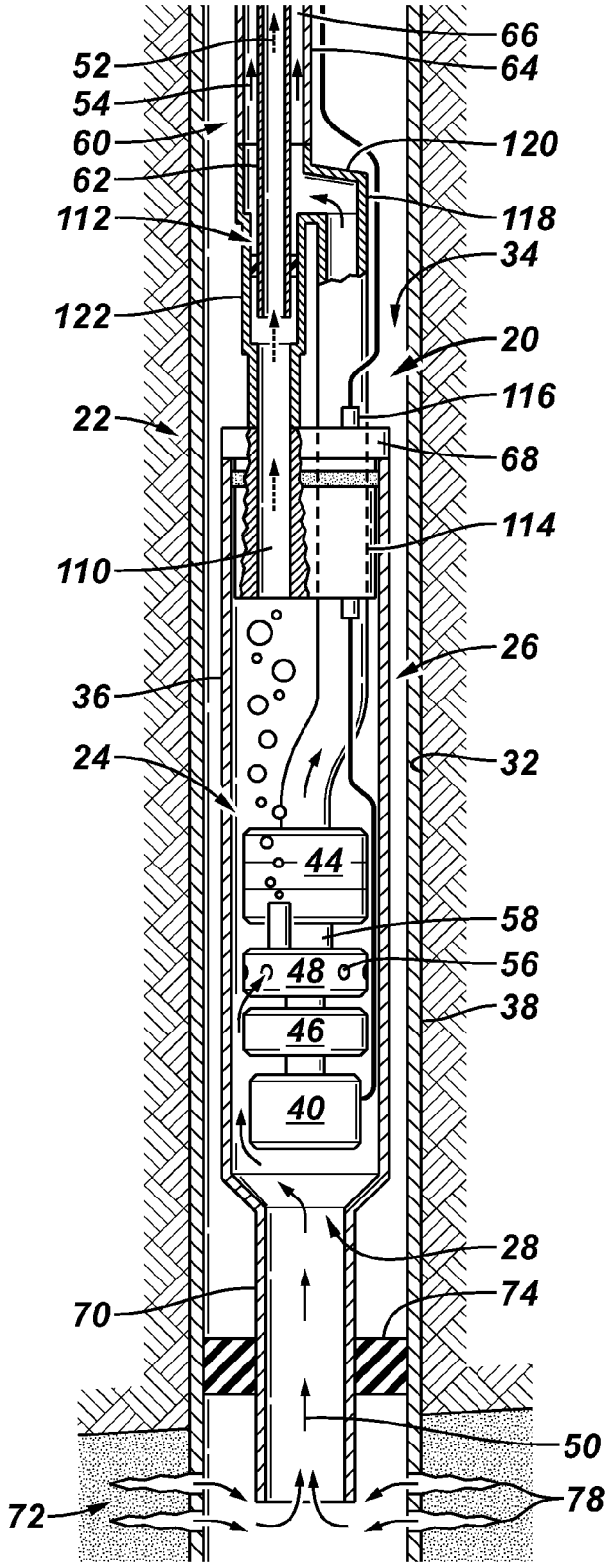
FIG. 7 is a schematic illustration of another example of a system for lifting fluids while deployed in a wellbore, according to an embodiment of the present invention.

In FIG. 7, another alternate embodiment of system 20 is illustrated in which a crossover assembly 118 is separate from pod hanger 68. The pod hanger 68 comprises gas component passage 110, liquid component passage 114, and a corresponding passage for cable penetrator 116. However, the crossover assembly 118 is a separate assembly spaced above pod hanger 68. By way of example, an upper portion of crossover assembly 118 may comprise a bypass tool 120 and a lower portion may comprise a cavity 122 for receiving inner tube stinger 112. The embodiment illustrated shows the gas component 52 being routed to inner tube 62 and the liquid component 54 being routed to annulus 66. However, the embodiments of FIGS. 6 and 7 may be designed to route the gas component 52 through annulus 66 and the liquid component 54 through inner tube 62; or the gas and liquid components may be routed through independent tubes, similar to the embodiment illustrated in FIG. 3.

Although several embodiments of system 20 have been illustrated and described, many variations in components and designs may be employed for a given application and/or environment. For example, a variety of electric submersible pumping system components may be incorporated into the design. In some embodiments, booster pumps may be incorporated to facilitate production of fluids from a downhole location. An example of a booster pump that is useful in some applications is the Poseidon™ booster pump available from Schlumberger Corporation as are a variety of submersible pumps and submersible motors which may be employed in the electric submersible pumping system.

Other components also may be adjusted or interchanged to accommodate specifics of a given application. For example, encapsulating structure 26 is not necessarily a pod. In some applications, the encapsulating structure 26 may comprise a permanent scab liner in the well with a female top connector, such as a polished bore receptacle in which a pod head is stabbed into the polished bore receptacle using a male seal assembly and latch mechanism. However, a variety of other encapsulating structures may be employed to isolate the flow of well fluid from the surrounding wellbore wall. Additionally, a variety of bottom feeder assemblies and other tubular structures may be employed to provide the desired routing of fluid components. Similarly, many types of sensors and other types of well monitoring devices may be incorporated into the overall system.

Although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A system for lifting fluids in a well, comprising:

a first electric submersible pumping system within an encapsulating structure having an opening for communication of a well fluid to an intake of the first electric submersible pumping system;

a second electric submersible pumping system;

a dual path structure positioned in cooperation with the first electric submersible pumping system and the encapsulating structure and the second electrical submersible pumping system, the dual path structure defining two independent flow channels, the independent flow channels being arranged to prevent contact between either of two fluids;

a first extension connected to the dual path structure and the first electric submersible pumping system for communication of one of the two fluids to one of the independent flow channels;

a second extension connected to the dual path structure and the second electric submersible pumping system for communication of the other of the two fluids to the other of the independent flow channels; and a support attached to the first extension and the second electric submersible pumping system for support of the second electric submersible pumping system.

2. The system as recited in claim 1, further comprising a well casing.

3. The system as recited in claim 2, wherein the dual path structure comprises concentric pipes located within the well casing.

4. The system as recited in claim 2, wherein the dual path structure comprises separate pipes located within the well casing.

5. The system as recited in claim 1, wherein the encapsulating structure comprises a pod.

6. The system as recited in claim 1 further comprising a seal bore packer, wherein a tubing extends downwardly from the encapsulating structure through the seal bore packer.

7. The system of claim 6 wherein the first electric submersible pumping system comprises an intake for receipt of the one of the two fluids via the tubing from a first zone below the seal bore packer and wherein the second electric submersible pumping system comprises an intake for receipt of the other of the two fluids from a second zone above the seal bore packer.

* * * * *